US008168056B2

(12) United States Patent
Datta et al.

(10) Patent No.: US 8,168,056 B2
(45) Date of Patent: May 1, 2012

(54) ELECTROCOMPOSITE COATINGS FOR HARD CHROME REPLACEMENT

(75) Inventors: Amitava Datta, East Greenwich, RI (US); John D. Carpenter, Trumbull, CT (US)

(73) Assignee: USC, LLC, Stratford, CT (US)

( * ) Notice: Subject to any disclaimer, the term of this patent is extended or adjusted under 35 U.S.C. 154(b) by 0 days.

(21) Appl. No.: 12/331,623

(22) Filed: Dec. 10, 2008

(65) Prior Publication Data

US 2009/0114543 A1 May 7, 2009

(51) Int. Cl.
*C25D 15/00* (2006.01)
*C25D 3/12* (2006.01)

(52) U.S. Cl. ..... 205/109; 205/227; 205/258

(58) Field of Classification Search ..... None
See application file for complete search history.

(56) References Cited

U.S. PATENT DOCUMENTS

| | | | | |
|---|---|---|---|---|
| 4,673,468 | A | 6/1987 | Myers et al. | |
| 5,178,643 | A * | 1/1993 | Schimweg | 51/293 |
| 5,358,547 | A * | 10/1994 | Holko | 75/254 |
| 5,496,463 | A | 3/1996 | Mori et al. | |
| 5,707,276 | A * | 1/1998 | Holko et al. | 451/356 |
| 6,607,614 | B1 * | 8/2003 | Richardson et al. | 148/403 |
| 7,897,265 | B2 * | 3/2011 | Nardi et al. | 428/627 |
| 7,955,721 | B2 * | 6/2011 | Smith et al. | 428/698 |
| 2002/0164262 | A1 * | 11/2002 | Engelhaupt et al. | 420/441 |
| 2004/0144656 | A1 | 7/2004 | Matsuda et al. | |
| 2005/0112399 | A1 | 5/2005 | Gray | |
| 2006/0040126 | A1 * | 2/2006 | Richardson et al. | 428/615 |
| 2007/0170068 | A1 | 7/2007 | Datta et al. | |

FOREIGN PATENT DOCUMENTS

| | | |
|---|---|---|
| EP | 06849984.7-1227 | 5/2010 |
| WO | WO 90/02220 A | 3/1990 |

OTHER PUBLICATIONS

Y. Fukunaka et al. "Fundamental Study on Electrodeposition of Co and Co-P Films"; Journal of the Electrochemical Society; vol. 141, No. 7, Jul. 1994; pp. 1783-1791.

M. L. Klingenberg et al. "Nano-particle composite plating as an alternative to hard chromium and nickel coatings"; AESF SUR/FIN 2003 Proceedings, 2003.

Brenner, Abner. "Electrodeposition of Alloys Principles and Practice", vol. II, pp. 457-483, © 1963 Academic Press Inc., New York, New York USA.

Response filed Mar. 2011 in Copending related EPO Application No. 06 849 984.7.

Office Action Mailed Apr. 2011 in Copending related EPO Application No. 06 849 984.7.

* cited by examiner

*Primary Examiner* — Harry D Wilkins, III

(74) *Attorney, Agent, or Firm* — Edwards Wildman Palmer LLP; Barry Kramer; Nicholas J. DiCeglie, Jr.

(57) ABSTRACT

The invention provides a method and system for electrolytically coating an article. The method includes providing an article to be coated and disposing the article in an electrolytic cell. The cell includes an anode, a cathode in operable communication with the article, and an electrolyte bath. During electrolysis, the electrolyte bath comprises cobalt ions, phosphorous acid, and tribological particles selected from the group consisting of refractory materials, solid lubricants and mixtures thereof dispersed therein. The method further includes applying steady direct electric current through the anode, the electrolyte bath and the cathode to coat the article with cobalt, phosphorous and the tribological particles. An improved composition of matter is also provided that may be used as a coating, or the composition may be electroformed on a mandrel to form an article made from the composition of matter.

22 Claims, 3 Drawing Sheets

102

ELECTROCOMPOSITE COATINGS FOR HARD CHROME REPLACEMENT

CROSS-REFERENCE TO RELATED APPLICATION

This application claims the benefit of priority from U.S. patent application Ser. No. 11/510,417, filed Aug. 26, 2006, which in turn claims the benefit of priority from U.S. Provisional Patent Application Ser. No. 60/761,445, filed Jan. 24, 2006. The disclosure of each of the aforementioned applications is incorporated by reference herein in its entirety.

BACKGROUND OF THE INVENTION

1. Field of the Invention

The present invention relates to an improved method and system for coating materials as well as improved protective coatings for materials. Particularly, the present invention is directed to a method and system for making a coating including cobalt, phosphorous and particles of material having superior tribological characteristics.

2. Description of Related Art

Electroplated hard chrome coating is widely used as a wear resistant coating to prolong the life of mechanical components. However, conventional hard chrome electroplating processes generate hexavalent chromium ion which is a known carcinogen. Hence, there is a major effort throughout the electroplating industry to replace hard chrome coatings with an environmentally benign, non-carcinogenic coating having characteristics similar or superior to those of hard chrome.

Thermal spray hard coatings of chromium carbide, tungsten carbide, tribaloy, aluminum oxide and the like, using Plasma Spray, High Velocity Oxy Fuel (HVOF) and other similar processes are currently being used to replace hard chrome coatings. However, these processes have not been able to be used for non line of sight (NLOS) applications, such as the inner diameter (ID) of cylinders, bearing cavities and the like. Even for the outer surface applications, thermal spray coatings are generally deposited in thick layers and later ground to a desired thickness. Hence, thermal sprayed coatings are generally more expensive than electroplated hard chrome.

For NLOS applications, a number of electroplated coatings have been evaluated. These include electroplated Ni—P and Ni—W alloy coatings, Ni—SiC electrocomposite and other similar coatings. However, none of these coatings have all the desired characteristics of hard chrome. Also, nickel base coatings are now considered undesirable because it has been found that in some cases they can cause severe allergic reactions.

Recently, a new nanocrystalline Co—P base coating has been developed by pulse plating processes. The resulting nanocrystalline Co—P coating appears to be a very promising replacement for hard chrome as its characteristics are either equal or superior to those of hard chrome. However, the electroplating process for this nanocrystalline Co—P base coating is based on pulse plating. In pulse plating, the applied voltage between the anode and cathode is pulsed at different amplitudes and at various frequencies. This pulse plating process used to produce nanocrystalline Co—P coatings requires special power supplies which are currently available only for laboratory research and development. Large scale affordable pulsed power supplies for the production environment are not currently available. Hence, there is a continued need for improved coatings and associated processes for replacing hard chrome. The present invention provides a solution for these and other problems.

SUMMARY OF THE INVENTION

The purpose and advantages of the present invention will be set forth in and become apparent from the description that follows. Additional advantages of the invention will be realized and attained by the methods and systems particularly pointed out in the written description and claims hereof, as well as from the appended drawings.

To achieve these and other advantages and in accordance with the purpose of the invention, as embodied herein, the invention includes a method for electrolytically coating an article. The method includes providing an article to be coated and disposing the article in an electrolytic cell. The cell includes an anode, a cathode in operable communication with the article, and an electrolyte bath. During electrolysis, the electrolyte bath comprises cobalt ions, phosphorous acid, and tribological particles selected from the group consisting of refractory materials, solid lubricants and mixtures thereof, dispersed therein. The method further includes applying steady direct electric current through the anode, the electrolyte bath and the cathode to coat the article with cobalt, phosphorous and the tribological particles.

In accordance with a further aspect of the invention, the electrolyte bath may include, for example, tribological particles of refractory material selected from the group consisting of ceramics, diamond and mixtures thereof. In accordance with one aspect of the invention, the electrolyte bath may include ceramic tribological particles selected from the group consisting of silicon carbide, chromium carbide, boron carbide, tungsten carbide, titanium carbide, silicon nitride, aluminum oxide, chromium oxide, and mixtures thereof. In accordance with another aspect of the invention, the electrolyte bath may include solid lubricant tribological particles selected from the group consisting of graphite, boron nitride, polytetrafluoroethylene ("PTFE"), molybdenum disulfide, tungsten disulfide, and mixtures thereof.

In accordance with another aspect of the invention, the phosphorous acid may be present in the electrolyte bath in a concentration from about 3 grams per liter to about 35 grams per liter. In accordance with another embodiment of the invention, the phosphorous acid is present in the electrolyte bath in a concentration from about 3 grams per liter to about 25 grams per liter. In accordance with a preferred embodiment of the invention, the phosphorous acid is present in the electrolyte bath in a concentration from about 3 grams per liter to about 15 grams per liter.

If desired, the anode may include a portion formed from consumable cobalt material adapted to release cobalt ions into the electrolyte bath as cobalt is deposited on an article to be coated. The consumable cobalt anode may comprise a cobalt plated electrode, and/or may include pieces of cobalt disposed in a basket or other suitable container in communication with the electrolyte bath. The source of cobalt ions may additionally or alternatively include, for example, a soluble cobalt salt selected from the group consisting of $CoSO_4$, $CoCl_2$, $CoCO_3$, $Co(SO_3NH_2)_2$ and mixtures thereof disposed in the electrolyte bath. If desired, an inert anode may be provided formed from a material selected from the group consisting of graphite, platinized copper, platinized titanium, platinized columbium or combinations thereof.

It is also possible to perform electroforming operations to produce cobalt parts in accordance with the invention. In accordance with this aspect of the invention, the cathode acts as a master, whereby a substrate, or coating, may be formed on the cathode and then removed from the cathode as a separate piece. The cathode may accordingly be made from a material that does not adhere significantly to the coating to facilitate its removal, such as passivated stainless steel. In accordance with a further aspect of the invention, the article to be coated may be the cathode of the cell.

In accordance with another aspect of the invention, the tribological particles in the electrolyte bath may have an average dimension between about 0.1 micrometers and about 20 micrometers. In accordance with a preferred embodiment of the invention, the tribological particles may have an average dimension between about 1.0 micrometers and about 5.0 micrometers.

In accordance with yet a further aspect of the invention, the electrolyte bath may further comprise a dissolution promoter for promoting the dissolution of the consumable cobalt material. The dissolution promoter may include, for example, a metal halide salt. In accordance with certain specific embodiments of the invention, the dissolution promoter may be selected from the group consisting of sodium chloride, cobalt chloride, metal bromide salts and combinations thereof. If desired, the electrolyte bath may further comprise a buffering agent, such as boric acid to help maintain the pH within a desired tolerance. Moreover, a pH adjustor may also be employed to control the pH of the system, such as cobalt carbonate, sodium hydroxide and sulfuric acid.

In accordance with one embodiment of the invention, the pH of the electrolyte bath may be between about 0.5 and about 2.0. In accordance with a preferred embodiment of the invention, the pH of the electrolyte bath is between about 0.8 and about 1.2. The temperature of the electrolyte bath may be between about 50° C. and about 90° C. In accordance with a preferred embodiment of the invention, the temperature of the electrolyte bath may be between about 70° C. and about 80° C. The electric current applied to the electrolyte bath may have a current density between about 0.2 Amps/in$^2$ to about 2.0 Amps/in$^2$. In accordance with one embodiment of the invention, the electric current may have a current density between about 0.5 Amps/in$^2$ to about 1.5 Amps/in$^2$.

In accordance with still another aspect of the invention, the concentration of cobalt in the electrolyte bath may be between about 50 grams per liter and about 200 grams per liter. In accordance with a preferred embodiment of the invention, the cobalt concentration in the electrolyte bath may be about 100 grams per liter. The tribological particles may be present in the electrolyte bath in a concentration from about 10 grams per liter to about 200 grams per liter. Specifically, the silicon carbide tribological particles may be present in the electrolyte bath in a concentration from about 10 grams per liter to about 200 grams per liter. In accordance with a preferred embodiment of the invention, the silicon carbide tribological particles are present in the electrolyte bath in a concentration from about 30 grams per liter to about 60 grams per liter. By way of further example, the chromium carbide tribological particles may be present in the electrolyte bath in a concentration from about 10 grams per liter to about 200 grams per liter. In accordance with a preferred embodiment of the invention, the chromium carbide tribological particles are present in the electrolyte bath in a concentration from about 35 grams per liter to about 100 grams per liter. The tribological particles may have an average dimension, for example, between about 0.1 micrometers and about 20 micrometers.

In accordance with still a further aspect of the invention, the article may be heat treated after the article has been coated to cause the precipitation of cobalt-phosphides. The article may be heat treated at a temperature between about 150° C. and about 500° C. In accordance with one example, the article is heat treated at a temperature between about 200° C. and about 400° C. The article may be heat treated for a length of time between about 15 minutes and about 180 minutes. The heat treatment temperature and duration are interrelated, in that a longer heat treatment may be appropriate at a lower temperature, and a shorter heat treatment may be appropriate at a higher temperature.

In further accordance with the invention, a system for electrolytically coating an article is provided comprising an electrolytic cell. The cell includes an anode, a cathode capable of being placed in operable communication with an article to be coated, and an electrolyte bath. The electrolyte bath is in operable communication with the anode and the cathode. During electrolysis, the electrolyte comprises cobalt ions, phosphorous acid, and tribological particles selected from the group consisting of refractory materials, solid lubricants and mixtures thereof dispersed therein. The system also includes a direct current power supply adapted to apply steady direct current across the anode, electrolyte bath and cathode to coat an article with cobalt, phosphorous and the tribological particles. The system can include all of the attributes needed to carry out the method steps of the invention described herein.

In further accordance with the invention, a composition of matter is provided. The composition of matter comprises cobalt, phosphorous and tribological particles selected from the group consisting of refractory materials, solid lubricants and mixtures thereof dispersed therein. The composition of matter may be formed according to the processes described herein. In accordance with one aspect of the invention, the coating may have a hardness of about 650-700 VHN. If the composition of matter is heat treated to form cobalt phosphides, the composition of matter may be harder. For example, the composition may include chromium carbide tribological particles and the coating may accordingly have a hardness of about 500 VHN prior to heat treatment. In accordance with another embodiment of the invention the coating may include silicon carbide tribological particles and the coating may have a hardness of about 1150 VHN subsequent to heat treatment.

It is to be understood that both the foregoing general description and the following detailed description are exemplary and are intended to provide further explanation of the invention claimed. The accompanying figures, which are incorporated in and constitute part of this specification, are included to illustrate and provide a further understanding of the method and system of the invention. Together with the description, the drawings serve to explain the principles of the invention.

DETAILED DESCRIPTION OF THE PREFERRED EMBODIMENT

Reference will now be made in detail to the present preferred embodiments of the invention, an example of which is illustrated in the accompanying drawings. The method and corresponding steps of the invention will be described in conjunction with the detailed description of the system.

The devices and methods presented herein may be used for producing improved coatings for articles that do not suffer from the deficiencies of coatings known in the prior art. The present invention may be practiced using a generally conventional DC power supply to produce cobalt-phosphorous base electrocomposite coatings having hardness, bend ductility and corrosion resistance similar or superior to those of hard chrome. Unlike nickel and chromium, cobalt does not present significant environmental considerations when used in electroplating. As such, it presents significant benefits over the use of techniques employing significant quantities of chromium or nickel.

In accordance with the invention, a system and associated method for electrolytically coating an article is provided comprising an electrolytic cell. The cell includes an anode, a cathode capable of being placed in operable communication with an article to be coated, and an electrolyte bath. The electrolyte bath is in operable communication with the anode and the cathode. During electrolysis, the electrolyte comprises cobalt ions, phosphorous acid, and tribological particles selected from the group consisting of refractory materials, solid lubricants and mixtures thereof dispersed therein. The system also includes a direct current power supply adapted to apply steady direct current across the anode, electrolyte bath and cathode to coat an article with cobalt, phosphorous and the tribological particles.

Figure 1:
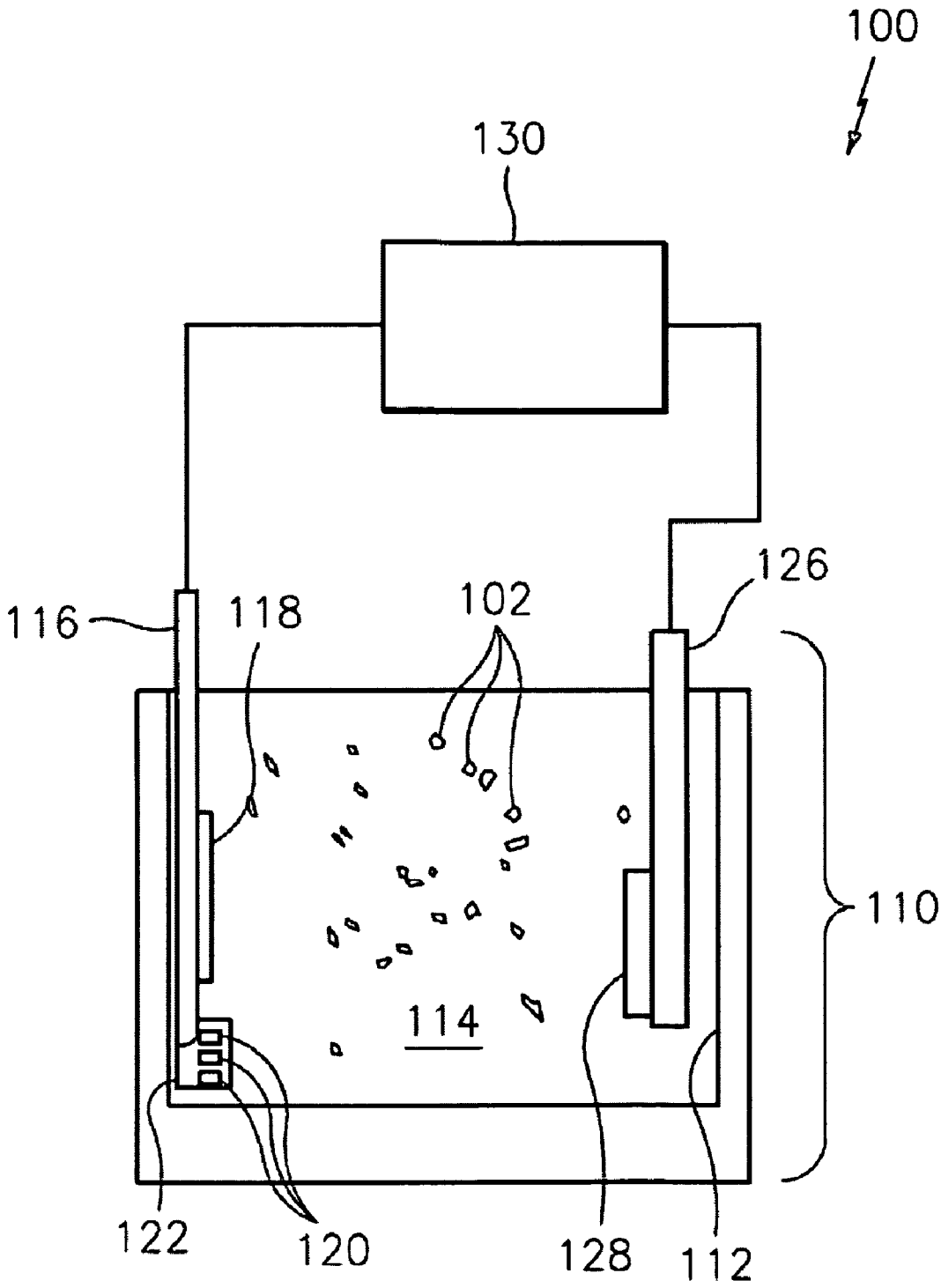
FIG. 1 is a schematic representation of an electroplating system made in accordance with the present invention.

For purpose of explanation and illustration, and not limitation, a partial view of an exemplary embodiment of the system in accordance with the invention is shown in FIG. 1 and is designated generally by reference character 100. Other embodiments of a system in accordance with the invention, or aspects thereof, are provided in FIGS. 2-3, as will be described.

For purposes of illustration and not limitation, as embodied herein and as depicted in FIG. 1, system 100 is provided with a cell 110. Cell 110 includes a container 112 adapted and configured to house an electrolyte bath 114. Cell further includes an anode 116 and a cathode 126 in electrical communication with a power supply 130.

The anode 116 may be formed from a variety of materials, for example, such as graphite, platinized copper, platinized titanium, platinized columbium and combinations thereof. If desired, the anode 116 may include a consumable portion (e.g., 118, 120) made from cobalt, wherein the anode 116 is adapted to release cobalt ions into the electrolyte bath 114 as cobalt is depleted from the bath, and deposited on an article to be coated. Suitable anodes 116 with consumable portions (e.g., 118 and/or 120) may be made in a variety of ways. For example, the anode 116 may be coated with cobalt to form a consumable portion 118 of any desired geometry, such as by electroplating cobalt onto a titanium or stainless steel anode. Additionally or alternatively, pieces 120 of cobalt may be disposed in a basket 122 or other suitable container made at least in part, for example, from titanium or other suitable conductive substantially non reactive material in communication with the electrolyte bath 114. The pieces 120 of cobalt dissolve when a voltage is applied across the anode 116 and cathode 126 to release cobalt ions into the electrolyte bath 114. Specifically, electrical current flows through the titanium basket 122 and to the cobalt, which in turn oxidizes and goes into solution in bath 114. Pieces 120 of cobalt metal are commercially available, for example, from Atlantic Metals and Alloys, Inc. in Stratford, Conn. The source of cobalt ions may additionally or alternatively include an additional soluble cobalt source selected, for example, from the group consisting of $CoSO_4$, $CoCl_2$, $CoCO_3$, $Co(SO_3NH_2)_2$ and mixtures thereof. Thus, for example, an inert anode 116 may be used, and additional CoSo4 may be added to bath 114 to replace cobalt in the bath as it is depleted due to deposition on the article to be coated and/or the cathode, as described in detail below. Suitable cobalt salts, such as cobalt sulfate, are commercially available, for example, from Shepherd Chemical Co., of Norwood Ohio, and distributed, for example, by Gilbert and Jones Co., Inc., of New Britain, Conn.

The cathode 126 may be made from a variety of materials as are known in the art. In accordance with one embodiment of the invention, the cathode 126 will generally include or otherwise be electrically attached to an article to be coated 128.

In accordance with a further aspect of the invention, an article may be electroformed by coating cathode 126 with a coating material and then releasing the coating from the cathode 126. In accordance with this aspect of the invention, the cathode 126 acts as a master, or mandrel, such that a "mirror" article is formed on the cathode by electroplating material onto the cathode 126. A variety of articles can be made in this manner, such as leading edge blades for helicopters, complex, difficult to machine shapes such as small bellows, among others. Accordingly, in accordance with this aspect of the invention, the cathode 126 can be made from a material that does not adhere strongly to the coating, such as passivated stainless steel. Stainless steel may be passivated by any known suitable method, for example, by exposure to hot chromic acid, nitric or citric acid to form an oxide layer on the cathode 126 to render it less reactive with a coating formed thereon.

It will be recognized that any suitable number of anodes 116 and cathodes 126 may be used, depending on what is being manufactured. For example, racks of articles 128 may be disposed in the electrolyte bath 114 to be coated. Each article 128 is in conductive communication with, and effectively acts as a cathode 126. Any suitable number of soluble and/or inert anodes 116 can be used, as desired. It will also be recognized that the anode(s) 116 should be located suitably with respect to the cathode(s) 126. If it is desired to coat the interior of a cylindrical article with a coating, it will be recognized that it is suitable to locate anode 116 within the cavity formed by the article.

The electrolyte bath 114 is in operable communication with the anode 116 and the cathode 126. During electrolysis, the electrolyte bath 114 comprises an electrolyte having cobalt ions, phosphorous acid and tribological particles selected from the group consisting of refractory materials, solid lubricants and mixtures thereof dispersed therein. The cobalt ions can be introduced in a variety of ways, as described above. The concentration of cobalt in the electrolyte bath may be between about 50 grams per liter and about 200 grams per liter, most preferably about 100 grams per liter.

The electrolyte bath 114 may further comprise a dissolution promoter for promoting the dissolution of the cobalt material. The dissolution promoter may include a halide salt. While a variety of salts can be used as dissolution promoters, suitable dissolution promoters may include, for example, sodium chloride, cobalt chloride, bromide salts and combinations thereof. In accordance with one embodiment, sodium chloride is used as a dissolution promoter in electrolyte bath 114 in an amount of about 20 grams per liter.

The pH of the electrolyte bath 114 may be between about 0.5 and about 2.0. In accordance with a preferred embodiment, the pH of the electrolyte bath is between about 0.8 and about 1.2. During the electroplating process, the pH of the electrolyte bath 114 increases. In order to maintain the pH within a desired range, one or more of a variety of buffering agents can be added to the electrolyte bath 114 to help maintain the pH within a desired tolerance. For example, a suitable buffering agent is boric acid. If used, the boric acid can act to buffer bath 114, particularly in the region of the cathode 126, where hydroxide tends to form, since some hydrolysis can potentially occur at high current densities. However, a buffering agent need not be used since the pH of bath 114 is generally very low, resulting in ample available hydrogen ions in bath 114 that are available to readily combine with any hydroxide formed by the cathode 126. If desired, pH adjustors may also be employed to increase or decrease the pH of the system. Suitable pH adjustors may include, for example, sulfuric acid, cobalt carbonate and sodium hydroxide. Cobalt carbonate is particularly attractive for increasing the pH since it dissociates to form cobalt, which can be used in plating, and carbon dioxide, which bubbles out of the bath 114 and is released to the atmosphere. It has been discovered that, while a variety of factors affect the efficacy of the electroplating process embodied herein, pH plays a significant role. As such, careful control of the pH of the electrolyte bath can lead to improved quality of the end-product.

It is also preferred to maintain a sufficient level of phosphorous acid in the electrolyte bath 114 suitable for electroplating a coating having sufficient amounts of phosphorous. Preferably, the weight percent of phosphorous in the resulting coating is between about 3% and 12%, preferably between about 4% and 7%. Accordingly, the phosphorous acid may be present in the electrolyte bath in a concentration from about 3 grams per liter to about 35 grams per liter. More preferably, the phosphorous acid is present in the electrolyte bath in a concentration from about 3 grams per liter to about 25 grams per liter. Most preferably, the phosphorous acid is present in the electrolyte bath in a concentration from about 3 grams per liter to about 15 grams per liter. If an inert anode 116 is used, the electroplating process is relatively less efficient resulting in slower cobalt deposition on the cathode 126. In this example of an inert anode 116, a lower concentration of phosphorous acid is needed. Specifically, since the reaction depositing cobalt is proceeding at a slower pace, relatively more phosphorous is deposited for a given concentration of phosphorous acid. In contrast, when a soluble (e.g., consumable) anode 116 is used, the reaction to deposit cobalt is relatively more efficient. Accordingly, to obtain suitable amounts of phosphorous in the coating, the concentration of phosphorous acid is correspondingly increased.

For purposes of illustration and not limitation, as embodied herein, electrolyte bath 114 also includes tribological particles 102 dispersed therein. The tribological particles 102 have superior tribological characteristics (i.e., characteristics that tend to cause a reduction in friction, an increase in lubrication and resulting decrease in the wear of surfaces containing the tribological particles 102) and preferably include refractory materials and/or solid lubricants. These particles are thus referred to as tribological particles herein. The refractory materials can include, for example, ceramics, diamond and mixtures thereof. More specifically, ceramic tribological particles may be selected from the group consisting of silicon carbide, chromium carbide, boron carbide, tungsten carbide, titanium carbide, silicon nitride, aluminum oxide, chromium oxide, and mixtures thereof, among others. Solid lubricant tribological particles, such as graphite, boron nitride, PTFE, molybdenum disulfide, tungsten disulfide, and mixtures thereof may also be used. It will be recognized that certain tribological particles, such as boron nitride, have both ceramic and lubricious properties.

The tribological particles 102 in the electrolyte bath 114 may have an average dimension, for example, between about 0.1 micrometers and about 20 micrometers. In accordance with a preferred embodiment of the invention, the tribological particles have an average dimension between about 1.0 micrometers and about 5.0 micrometers. If silicon carbide tribological particles are employed, they may be present in the electrolyte bath in a concentration from about 10 grams per liter to about 200 grams per liter, preferably from about 30 grams per liter to about 60 grams per liter. If chromium carbide tribological particles are used, they may be present in the electrolyte bath in a concentration from about 10 grams per liter to about 200 grams per liter. In accordance with a preferred embodiment of the invention, the chromium carbide tribological particles are present in the electrolyte bath in a concentration from about 35 grams per liter to about 100 grams per liter.

Figure 2:
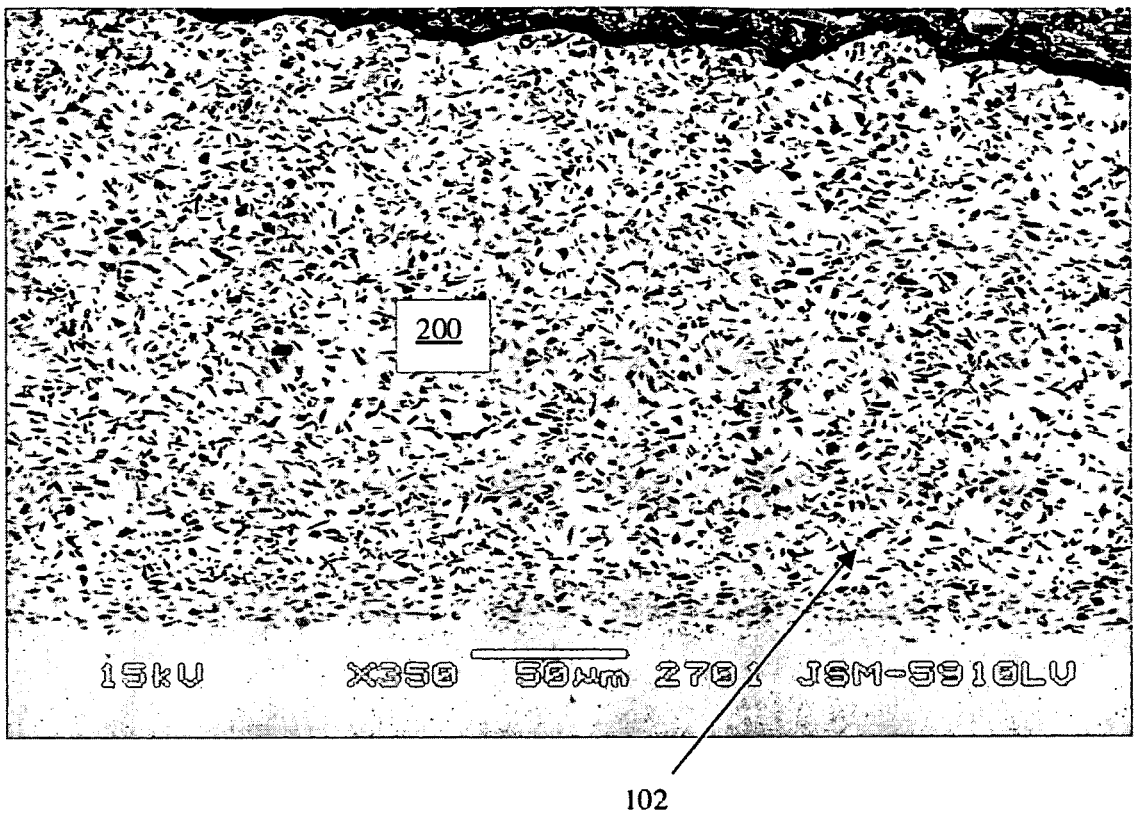
FIG. 2 is a photomicrograph showing the microstructure of a typical Co—P—SiC electrocomposite coating containing about 5-6 weight percent phosphorous made in accordance with the present invention.
Figure 3:
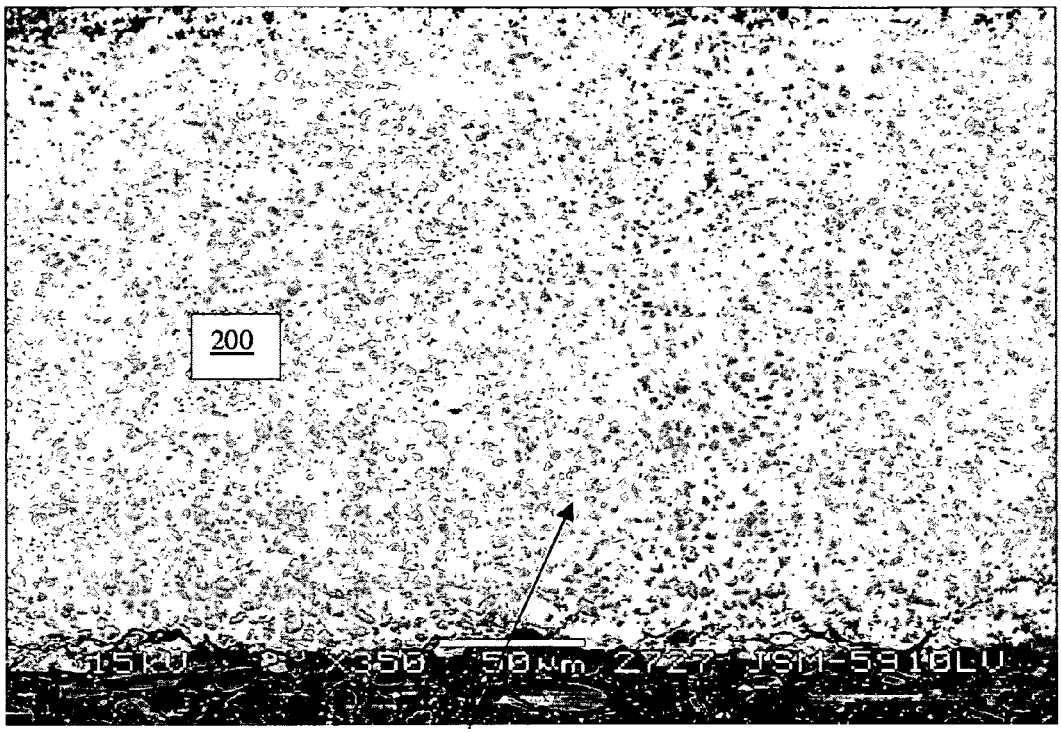
FIG. 3 is a photomicrograph showing the microstructure of a typical Co—P—$Cr_3C_2$ electrocomposite coating containing about 5-6 weight percent phosphorous made in accordance with the present invention.

FIG. 2 is a cross-sectional photomicrograph of a coating showing the microstructure of a typical Co—P—SiC electrocomposite coating containing about 5-6 weight percent phosphorous. Similarly, FIG. 3 is a cross-sectional photomicrograph of a coating showing the microstructure of a typical Co—P—$Cr_3C_2$ electrocomposite coating containing about 5-6 weight percent phosphorous. The tribological particles occupy about 25% of the volume of each of the coatings depicted in FIG. 2 and FIG. 3. The samples depicted in FIGS. 2 and 3 have not been heat treated. As can be seen in the Figures, the tribological particles 102 are dispersed throughout the coating 200. As further depicted, the coating 200 is metallurgically sound and crack-free. In contrast, a chromium coating generally demonstrates many micro cracks throughout the coating which degrade its corrosion resistance.

The temperature of the electrolyte bath 114 may be between about 50° C. and about 90° C. Temperatures below about 50° C., while possible, can be disadvantageous because of lower deposition rates of the coating and inefficient incorporation of phosphorous into the coating. On the other hand, temperatures in excess of about 90° C. generally results in excessive loss of material from the electrolyte bath 114 by way of evaporative mechanisms. In accordance with a preferred embodiment of the invention, the temperature of the electrolyte bath may be between about 70° C. and about 80° C.

As depicted in FIG. 1, direct current power supply 130 is adapted to apply steady direct current across the anode 116, electrolyte bath 114 and cathode 126 to coat an article (e.g., 128) with cobalt, phosphorous and the tribological particles. In operation, the electric current applied to the electrolyte bath may have a current density between about 0.2 Amps/$in^2$ to about 2.0 Amps/$in^2$. In accordance a preferred embodiment of the invention, the electric current may have a current density between about 0.5 Amps/$in^2$ to about 1.5 Amps/$in^2$. Power supply 130 can be similar to rectifiers as are known in the art, such as Model P-106-0.25CF rectifier commercially available from Aldonex, Inc. in Bellwood, Ill., among others.

Prior art, such as U.S. Pat. No. 5,352,255 to Erb et al. describe nano crystalline cobalt phosphorous coatings with a grain size smaller than 100 nm. Such coatings have characteristics either similar or superior to hard chrome and can be used as a replacement of hard chrome. However, to form nanocrystalline cobalt phosphorous coatings, it is necessary to use complex and expensive pulsed DC power supplies. Applicants have discovered that the addition of tribological particles 102 as described herein to the electrolyte bath has made it possible to produce a metallurgically sound, crack free coating with high hardness and ductility which can be used to replace hard chrome. Unlike the teachings of Erb et al., the systems made in accordance with the invention are capable of using the conventional steady DC power supplies known in the art.

In accordance with still a further aspect of the invention, the coating formed on the article coated during the electroplating process may be heat treated to cause the precipitation of cobalt-phosphides within the coating. To cause this precipitation, the article may be heat treated in an oven, for example, in the presence of air. Suitable ovens can be obtained from Lindberg/Blue of Thermo Electron Corp. located in Asheville, N.C. A Lindberg furnace Type No. 51662 was used to perform the heat treatments described in the Examples below, but it will be recognized that other similar furnaces are suitable.

The heat treatment can occur, for example, at a temperature between about 150° C. and about 500° C. for a length of time between about 15 minutes and about 180 minutes. In accordance with one embodiment, the article is heat treated at a temperature between about 200° C. and about 400° C. The heat treatment temperature and duration are interrelated, in that a longer heat treatment may be appropriate at a lower temperature, and a shorter heat treatment may be appropriate at a higher temperature.

In further accordance with the invention, a composition of matter is provided comprising cobalt, phosphorous and tribological particles selected from the group consisting of refractory materials, solid lubricants and mixtures thereof dispersed therein. The composition of matter may be used as a protective coating applied to an article, or may constitute a separate member electroformed on a mandrel as described herein. The composition of matter may be formed, for example, according to the processes described herein.

Prior to heat treatment, the cobalt-phosphorous-tribological particle coating generally has a hardness of about 650-700 VHN. If this coating is heat treated to precipitate cobalt phosphides, the resulting coating is harder. Experience has resulted in coatings comprising cobalt, phosphorous and chromium carbide tribological particles having a hardness of about 1000 VHN or greater. Coatings using silicon carbide instead of chromium carbide have been formed having a hardness of about 1150 VHN or greater. The desired characteristics of coatings disclosed herein are maintained by controlling electroplating parameters and electrolyte bath composition as described herein.

The following Examples further illustrate the present invention. Unless otherwise indicated, stated percentages are by weight.

Example I

Carbon steel samples were plated in accordance with the present invention. An electroplating bath was provided having the following composition:

| | |
|---|---|
| Cobalt sulfate: | 520 g/l |
| Boric acid: | 40 g/l |
| Sodium chloride: | 20 g/l |
| Granular phosphorous acid: | 15 g/l |
| Silicon carbide particles(2-5 microns): | 25 g/l |

The bath was made by mixing the above ingredients in water to a total volume of 3.5 liters. Electroplating was performed with cobalt pieces in a titanium basket used as an anode and plain carbon steel panels as cathode. One side of each carbon steel panel was masked and the side facing the anode was plated with a cobalt-phosphorous-silicon carbide coating.

Plating Conditions

The bath pH was maintained at about 0.9 with sulfuric acid to lower pH and sodium hydroxide to raise pH. The bath temperature was maintained between about 70° C.-80° C. The samples were plated at a current density of 2 Amperes/square inch. The panels were plated for about an hour which produced a coating thickness around 0.005 inch.

Coating Properties

Phosphorous content of the coating was about 9 wt %. As-plated hardness of the coating was 720 VHN. The coating was heat treated in air at 400° C. for 1.5 hrs. The as heat treated hardness was 1150 VHN.

Example II

Comparison with Hard Chrome

Materials made in accordance with the invention have properties equaling or even exceeding those of hard chrome as shown in Table I, below. Table I compares conventional hard chrome processing with exemplary parameters provided by the present invention. As can be seen, materials made in accordance with the present invention compare favorably with chrome and significantly surpass chrome in corrosion prevention.

TABLE I

Comparison of Co—P—SiC and Hard Chrome

| Feature | Co—P—SiC | Hard Chrome |
|---|---|---|
| Power supply | Conventional DC | Conventional DC |
| Plating rate | Up to 0.005"/hr | Up to 0.0016"/hr |
| Thickness | Plated up to 0.02" | Typically <0.02" |
| As-plated condition | Crack free | Micro cracked |
| Micro structure | ~50 nm grains with 2-5 μm SiC particles | Normal grain size, >1000 nm |
| As-plated hardness | 650 | 800-1200 |
| As heat treated hardness, 200° C./.1.5 hrs | 760 | — |
| As heat treated hardness, 400° C./1.5 hrs | 1200 | — |
| Bend ductility, 0.003" thick, 90° bend | A few fine cracks at the bend | No visible cracks at the bend |
| Threshold strain* | Similar to HVOF T-400** coating | Much lower than HVOF T-400 coating |
| Corrosion resistance Salt fog test (ASTM B117) | No visible rust even after 200 hrs | Rust after 24 hrs |

*Total strain to initiate a crack.

**T-400 is tribaloy 400 coating deposited by using HVOF thermal spray process

Example III

Effect of Phosphorous Acid Concentration on Hardness

It has also been discovered that the amount of phosphorous acid in the electrolyte bath has a measurable effect on the hardness of the produced coating. For example, lowering the concentration significantly below 5 grams per liter or raising it significantly above 25 grams per liter begins to show a drop off in coating hardness, as shown in Table II and Table III, below.

TABLE II

As-plated and as-heat treated hardness of Co—P—SiC* coatings as function of $H_3PO_3$ in the plating electrolyte bath.

| $H_3PO_3$ concentration | As-plated hardness | As-heat treated hardness. HT @ 400° C. for 1.5 hours |
|---|---|---|
| 0 g/L | 360 VHN | 350 VHN |
| 5 g/L | 669 VHN | 1012 VHN |
| 15 g/L | 720 VHN | 1147 VHN |
| 25 g/L | 736 VHN | 1236 VHN |
| 35 g/L | 660 VHN | 1150 VHN |

*Concentration of SiC is 25 g/L in plating bath.

TABLE III

As-plated and as-heat treated hardness of Co—P—$Cr_3C_2$* coatings as a function of $H_3PO_3$ in the plating bath.

| $H_3PO_3$ concentration | As-plated hardness | As-heat treated hardness. HT @ 400° C. for 1.5 hours |
|---|---|---|
| 0 g/L | 360 VHN | 350 VHN |
| 9 g/L | 663 VHN | 1008 VHN |
| 15 g/L | 670 VHN | 1053 VHN |
| 25 g/L | 681 VHN | 1089 VHN |
| 35 g/L | 636 VHN | 1019 VHN |

*Concentration of $Cr_3C_2$ is 50 g/L in plating bath.

Example IV

Increase in Hardness by Adding Tribological Particles

Table IV compares the as plated and as heat treated hardness of cobalt-phosphorous with composite cobalt-phosphorous coatings further including chromium carbide and silicon carbide. Tables V and VI below show the relative increase in hardness of the cobalt-phosphorous coating with the composite coatings. As can be seen, the addition of the carbide tribological particles results in a surprising increase in the hardness of the material after the precipitation of cobalt-phosphides.

TABLE IV

As-plated and as-heat treated hardness of Co—P, Co—P—$Cr_3C_2$ and Co—P—SiC coatings with 5 g/L $H_3PO_3$ in the plating bath. Samples were heat treated at 325° C. for 0.5 hours.

| Coating | As-plated hardness (VHN) | As-heat treated hardness HT @ 325° C. for 0.5 hours | Hardness increase |
|---|---|---|---|
| Co—P | 650 | 700 VHN | 50 VHN |
| Co—P—$Cr_3C_2$* | 670 | 1010 VHN | 340 VHN |
| Co—P—SiC** | 669 | 1150 VHN | 480 VHN |

*50 g/L $Cr_3C_2$ in plating bath
**25 g/L SiC in plating bath

TABLE V

As-plated and as-heat treated hardness of Co—P and Co—P—SiC with 5 g/L $H_3PO_3$ in the plating bath. Samples were heat treated at 205° C. and 400° C. for 1.5 hours.

| Coating | As-plated hardness | As-heat treated hardness HT @ 205° C. for 1.5 hours | As-heat treated hardness HT @ 400° C. for 1.5 hours |
|---|---|---|---|
| Co—P | 650 VHN | 688 VHN (Δ = 38 VHN) | 1000 VHN (Δ = 350 VHN) |
| Co—P—SiC** | 669 VHN | 756 VHN (Δ = 87 VHN) | 1216 VHN (Δ = 547 VHN) |

**25 g/L SiC in plating bath

Example V

Comparative Enhanced Bend Ductility

The Co—P—SiC and Co—P—$Cr_3C_2$ coatings also have superior bend ductility compared to the Co—P coating having similar wt % P and coating thickness. For example, steel panels 4"×1"×0.04", were plated with about 0.002" coatings using coating conditions described herein. Panels were coated on one side only by masking the other side. The panels were held in a vice and bent through 180° in the middle of the panels with the coating on the convex side of the bend. The coating was examined for cracks and delamination. The majority of the panels coated only with cobalt and phosphorous (i.e., without tribological particles) showed large cracks or complete delamination at the bent convex surface.

In surprising contrast, the Co—P—SiC and Co—P—$Cr_3C_2$ coatings did not delaminate. To the contrary, only fine cracks were observed at the bend. This simple bend test, although qualitative, does indicate an enhanced ductility of the Co—P—SiC and Co—P—$Cr_3C_2$ coatings. Generally, it would be expected that inclusion of tribological particles would make the coating more brittle. However, the Co—P—SiC and Co—P—$Cr_3C_2$ coatings possess an unexpected combination of high hardness and ductility. It has generally been discovered that the heat treatment temperatures to emphasize ductility are lower than those used to increase hardness.

The compositions of matter, methods and systems of the present invention, as described above and shown in the drawings, provide for a material with superior properties including enhanced corrosion resistance, and hardness and other properties similar to hard chrome, without the environmental hazards associated with electroplating chromium. It will be apparent to those skilled in the art that various modifications and variations can be made in the present invention without departing from the spirit or scope of the invention. Thus, it is intended that the present invention include modifications and variations that are within the scope of the appended claims and their equivalents.

What is claimed is:

1. A method for electrolytically coating an article, comprising:

a) providing an article to be coated;

b) disposing the article in an electrolytic cell, the cell including a soluble anode, a cathode in operable communication with the article, and an electrolyte bath, the electrolyte bath, during electrolysis, comprising cobalt ions from the soluble anode, phosphorous obtained by separately introducing phosphorous acid into the bath, and ceramic tribological particles selected from the group consisting of silicon carbide, chromium carbide, boron carbide, tungsten carbide, titanium carbide, silicon nitride, aluminum oxide, chromium oxide, and mixtures thereof dispersed therein, wherein the pH of the electrolyte bath is between about 0.5 and about 2.0;

c) applying steady direct electric current through the anode, the electrolyte bath and the cathode at a current density between about 0.2 Amps/in$^2$ and about 2.0 Amps/in$^2$ to coat the article with a coating that is essentially free of nickel and contains cobalt, phosphorous and the tribological particles, wherein the weight percent of phosphorous in the resulting coating is between about 3% and about 12%; and d) heat treating the article after it has been coated to cause the precipitation of cobalt-phosphides at a temperature between about 150° C. and about 500° C.

2. The method of claim 1, wherein the phosphorous acid is present in the electrolyte bath in a concentration from about 3 grams per liter to about 35 grams per liter.

3. The method of claim 1, wherein the phosphorous acid is present in the electrolyte bath in a concentration from about 3 grams per liter to about 15 grams per liter.

4. The method of claim 1, wherein the source of cobalt ions further includes a soluble cobalt source selected from the group consisting of $CoSO_4$, $CoCl_2$, $CoCO_3$, $Co(SO_3NH_2)_2$ and mixtures thereof.

5. The method of claim 1, wherein the tribological particles have an average dimension between about 0.1 micrometers and about 20 micrometers.

6. The method of claim 1, wherein the electrolyte bath further comprises a buffering agent including boric acid.

7. The method of claim 1, wherein the pH of the electrolyte bath is between about 0.8 and about 1.2.

8. The method of claim 1, wherein the temperature of the electrolyte bath is between about 50° C. and about 90° C.

9. The method of claim 1, wherein the temperature of the electrolyte bath is between about 70° C. and about 80° C.

10. The method of claim 1, wherein the electric current has a current density between about 0.5 Amps/in$^2$ to about 1.5 Amps/in$^2$.

11. The method of claim 1, wherein the article is heat treated for a length of time between about 15 minutes and about 180 minutes, and wherein the article has a hardness after heat treatment of about 1000 VHN or greater.

12. The method of claim 1, wherein the concentration of cobalt in the electrolyte bath is between about 50 grams per liter and about 200 grams per liter.

13. The method of claim 1, wherein the cobalt concentration in the electrolyte bath is about 100 grams per liter.

14. The method of claim 1, wherein the tribological particles include silicon carbide particles in a concentration from about 10 grams per liter to about 200 grams per liter.

15. The method of claim 1, wherein the tribological particles include silicon carbide particles in a concentration from about 30 grams per liter to about 60 grams per liter.

16. The method of claim 1, wherein the tribological particles include chromium carbide particles in a concentration from about 10 grams per liter to about 200 grams per liter.

17. The method of claim 1, wherein the tribological particles include chromium carbide particles in a concentration from about 35 grams per liter to about 100 grams per liter.

18. The method of claim 1, wherein the cobalt in the bath is derived from a cobalt sulfate source.

19. The method of claim 1, wherein the phosphorous acid is introduced in a granular form.

20. The method of claim 1, wherein the resulting coating has an as-plated hardness of about 650 VHN or greater.

21. The method of claim 1, wherein the electrolyte bath includes silicon carbide tribological particles.

22. The method of claim 1, wherein the electrolyte bath includes chromium carbide tribological particles.

* * * * *